US011709039B1

(12) United States Patent
Clevenger

(10) Patent No.: US 11,709,039 B1
(45) Date of Patent: Jul. 25, 2023

(54) FIREWORK LAUNCH PLATFORM

(71) Applicant: Nathaniel Lee Clevenger, Pittsburg, KS (US)

(72) Inventor: Nathaniel Lee Clevenger, Pittsburg, KS (US)

( * ) Notice: Subject to any disclaimer, the term of this patent is extended or adjusted under 35 U.S.C. 154(b) by 0 days.

(21) Appl. No.: 17/580,328

(22) Filed: Jan. 20, 2022

Related U.S. Application Data

(60) Provisional application No. 63/139,372, filed on Jan. 20, 2021.

(51) Int. Cl.
*F42B 4/20* (2006.01)

(52) U.S. Cl.
CPC ..... *F42B 4/20* (2013.01)

(58) Field of Classification Search
CPC ..... F42B 4/00; F42B 4/20
USPC ..... 102/361
See application file for complete search history.

(56) References Cited

U.S. PATENT DOCUMENTS 841,012 A * 1/1907 Helm ..... B25B 1/125 269/212
5,567,907 A * 10/1996 Westfall ..... F42B 4/20 102/361
6,295,307 B1 * 9/2001 Hoden ..... H01S 5/02365 372/36
8,118,157 B1 * 2/2012 Piccolin ..... F42B 4/20 206/564
10,859,351 B1 * 12/2020 Bolduc ..... F42B 4/20
2004/0217020 A1 * 11/2004 Price ..... F42B 4/20 206/3
2015/0176946 A1 * 6/2015 Montgomery ..... F41F 1/06 89/1.816
2018/0188003 A1 * 7/2018 Wu ..... F42B 4/00

FOREIGN PATENT DOCUMENTS

EP 2221574 A1 * 8/2010 ..... F42B 4/06

* cited by examiner

*Primary Examiner* — John Cooper
(74) *Attorney, Agent, or Firm* — Plager Schack LLP; Mark H. Plager; Kara K. Verryt

(57) ABSTRACT

A launch platform for securing pyrotechnic explosives prior to, during, and after detonation may include a cake stand portion and a mortar board portion. The cake stand portion and the mortar board portion may be integrated into a singular launch pad or may be removably connected to one another. The cake stand portion may include a base; a stationary clamping wall fixedly attached to and extending substantially perpendicularly upwards from the base; a moveable clamping wall slidably engaged with the base; and a ratcheting system operatively attached to the movable clamping wall, the ratcheting system configured to provide for movement and securement of the moveable clamping wall. The mortar board portion may include at least one mortar board slot sized to accommodate a mortar shell therein.

9 Claims, 4 Drawing Sheets

FIREWORK LAUNCH PLATFORM

RELATED APPLICATION

This application claims priority to provisional patent application U.S. Ser. No. 63/139,372 filed on Jan. 20, 2021, the entire contents of which is herein incorporated by reference.

BACKGROUND

The embodiments described herein relate generally to accessories for explosive pyrotechnic devices and, more particularly, to a launch platform designed to increase safety during firework detonation.

During fireworks displays, and particularly surrounding the Fourth of July celebrations in the United States, it is common to see and hear of fireworks falling over while they are discharging. This can, and has, caused injuries to those who are spectating or detonating. Many of these incidents result in quite serious injuries.

Currently, particularly for consumer fireworks, there is not an efficient and safe launch pad for securing fireworks available on the market. As such, consumers resort to makeshift strategies, which are often unsafe, for holding fireworks pre-detonation, during detonation, and post detonation.

Therefore, what is needed is a platform to safely and easily secure a firework to reduce the chance of it tipping or falling over when detonated or discharges, thus reducing the likelihood of injuries to spectators and the like.

SUMMARY

Some embodiments of the present disclosure include launch platform for securing pyrotechnic explosives prior to, during, and after detonation. The launch platform may include a cake stand portion and a mortar board portion. The cake stand portion and the mortar board portion may be integrated into a singular launch pad or may be removably connected to one another. The cake stand portion may include a base; a stationary clamping wall fixedly attached to and extending substantially perpendicularly upwards from the base; a moveable clamping wall slidably engaged with the base; and a ratcheting system operatively attached to the movable clamping wall, the ratcheting system configured to provide for movement and securement of the moveable clamping wall. The mortar board portion may include at least one mortar board slot sized to accommodate a mortar shell therein.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a launch platform for pyrotechnics and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

By way of example, and referring to FIGS. 1-11, some embodiments of the present disclosure include a launch platform for fireworks, the launch platform comprising a board designed to hold an explosive prior to, during, and after detonation.

Figure 1:
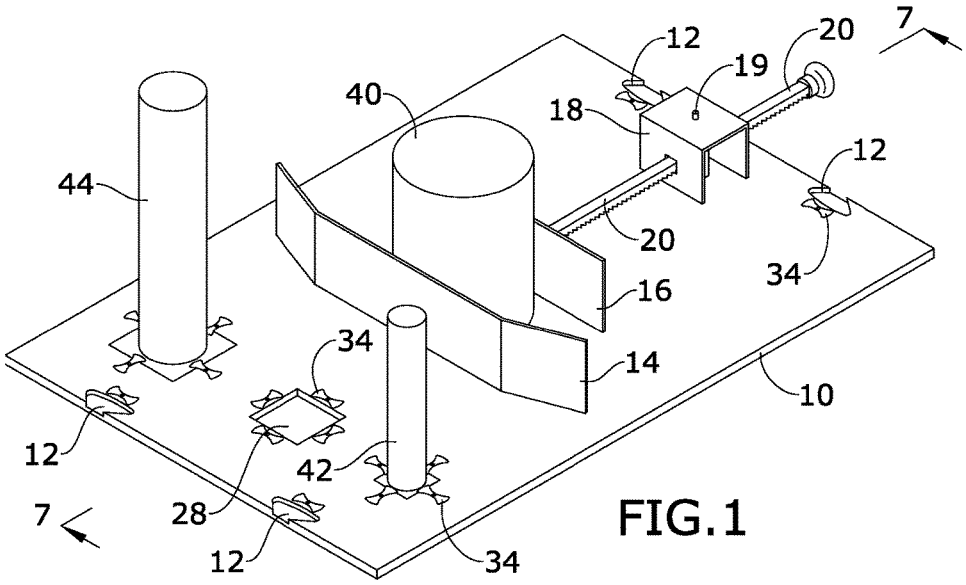
FIG. 1 is a perspective view of one embodiment of the present disclosure, shown in use.
Figure 2:
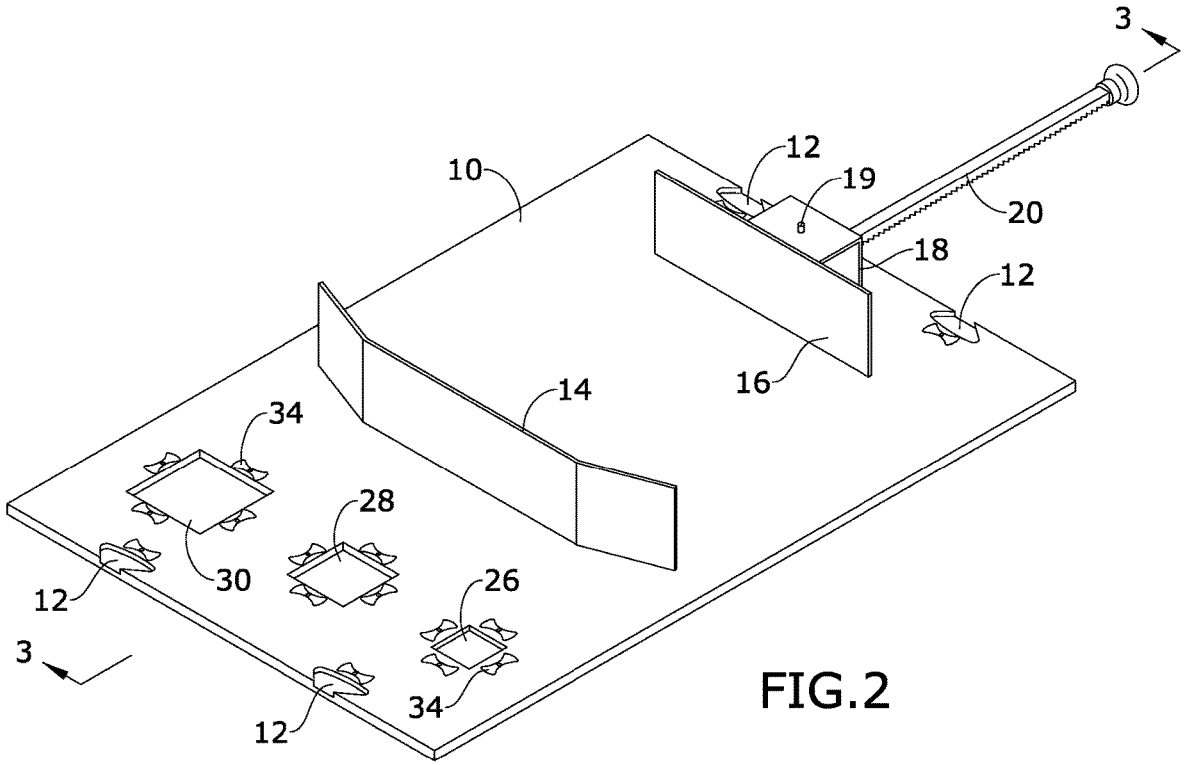
FIG. 2 is a perspective view of one embodiment of the present disclosure.
Figure 3:
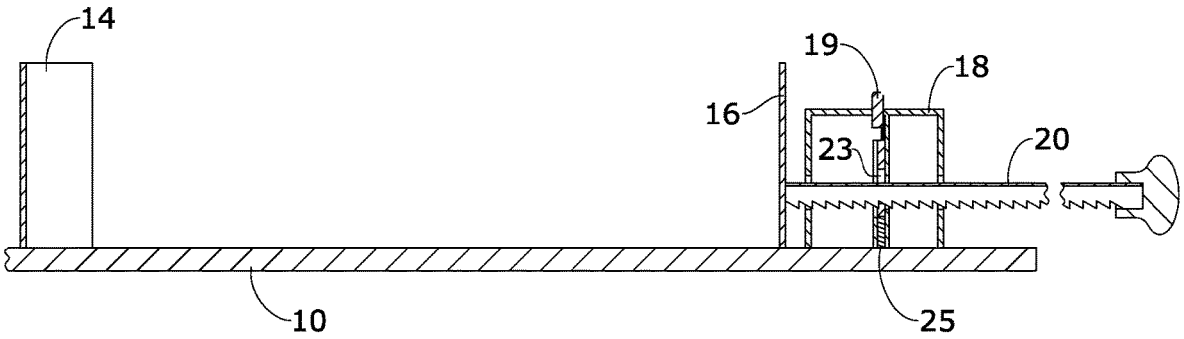
FIG. 3 is a section view of one embodiment of the present disclosure, taken along line 3-3 in FIG. 2.

In some embodiments, and as shown in FIGS. 1 and 3, the launch platform may comprise a substantially planar launch board 10, wherein a first portion of the launch board 10 comprises a mortar board portion 22 and a second portion of the launch board 10 comprises a cake stand portion 36, wherein the mortar board portion 22 and the cake stand portion 36, together, form one solid single pieced launch platform. In other embodiments, described in more detail below, the cake stand portion 36 and the mortar board portion 22 may be two distinct and separate pieces that can join together to form the launch board 10.

Figure 10:
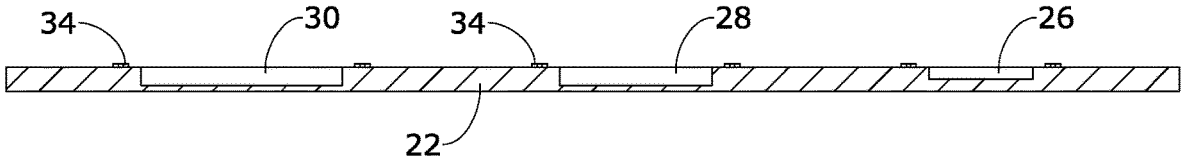
FIG. 10 is a section view of one embodiment of the present disclosure, taken along line 10-10 in FIG. 9.
Figure 11:
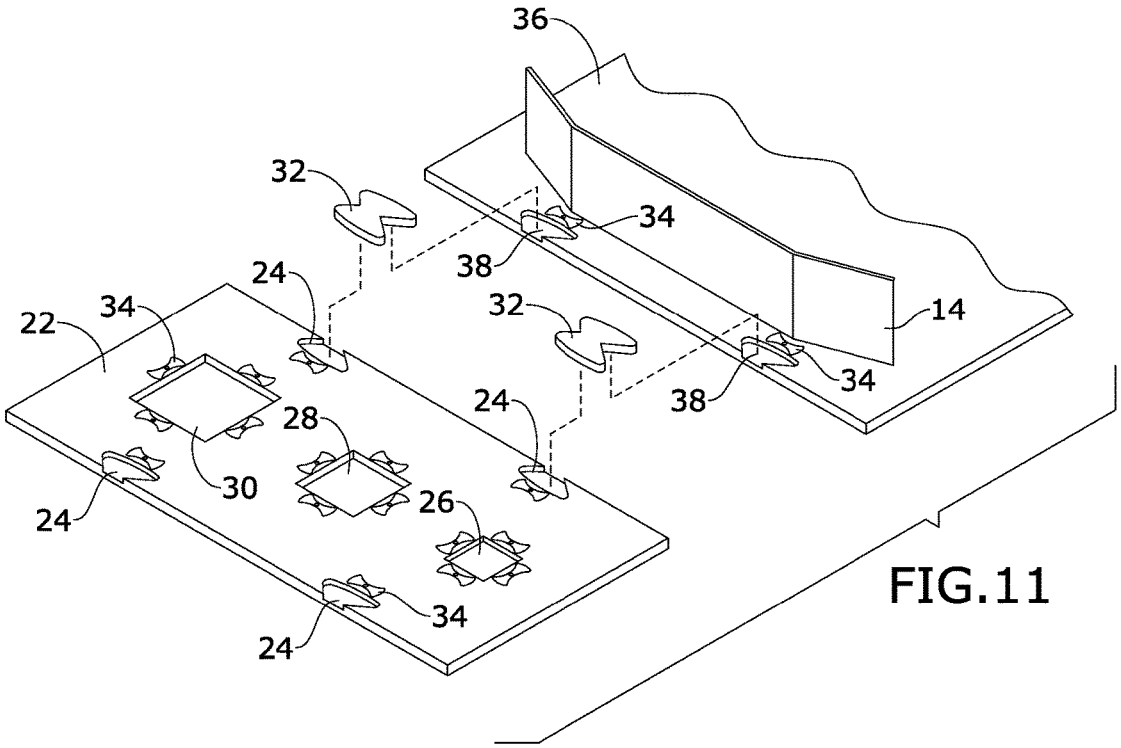
FIG. 11 is an exploded view of one embodiment of the present disclosure.

The mortar board portion 22 may comprise a plurality of notches or orifices sized to accommodating position of a bottom portion of an explosive therein. For example, the mortar board portion 22 may comprise a large mortar board slot 30, a medium mortar board slot 28, and a small mortar board slot 26 sized to accommodate placement of a large mortar shell 44, a medium mortar shell, and a small mortar shell 42 therein. As shown in FIG. 10, the large mortar board slot 30, the medium mortar board slot 28, and the small mortar board slot 26 may each comprise notches, such as rectangular or square-shaped notches, that extend partially through the launch board 10. Each of the base slots may comprise a plurality of spinning retainers 34, such as four spinning retainers 34, surrounding the edges thereof, such that once a mortar is placed into the base slot, the spinning retainers 34 may be pivoted to secure the mortar into the base slot as shown in FIG. 1. While not particularly limited, the spinning retainers 34 may be substantially hourglass shaped, as shown in the Figures. While the Figures show the mortar board portion 22 comprising three base slots, a mortar board portion 22 containing more or fewer base slots of varying shapes and sizes is envisioned.

The cake stand portion 36 may comprise a clamping holder that adjustably opens and closes using a ratcheting system to secure a firework 40 prior to, during, and after detonation. The clamping holder may comprise a stationary clamping wall 14 fixedly attached to and extending substantially perpendicular upward from the launch board 10 proximate to a center region thereof. As shown in the Figures, the stationary clamping wall 14 may have a central straight wall section that is substantially parallel to an outer edge of the launch board 10 and an angled wall section extending from each end of the straight wall section, wherein the stationary wall 14 extends from a location proximate to a first side edge of the launch board 10 to a location proximate to a second side edge (opposite the first side edge) of the launch board 10. The clamping holder may further comprise a movable clamping wall 16 slidably engaged with the launch board 10, wherein the movable clamping wall 16 is designed to move toward and away from the stationary clamping wall 14, as needed, to securely accommodate placement of a firework 40 between the stationary clamping wall 14 and the movable clamping wall 16.

Figure 4:
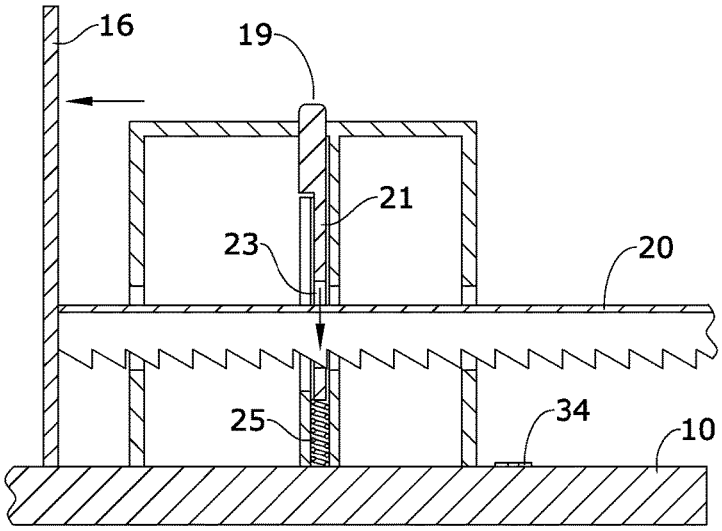
FIG. 4 is a detail section view of one embodiment of the present disclosure.
Figure 6:
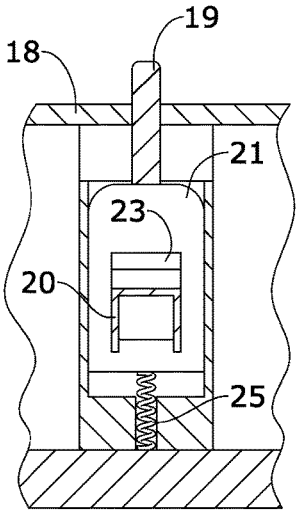
FIG. 6 is a section view of one embodiment of the present disclosure, taken along line 6-6 in FIG. 5.
Figure 5:
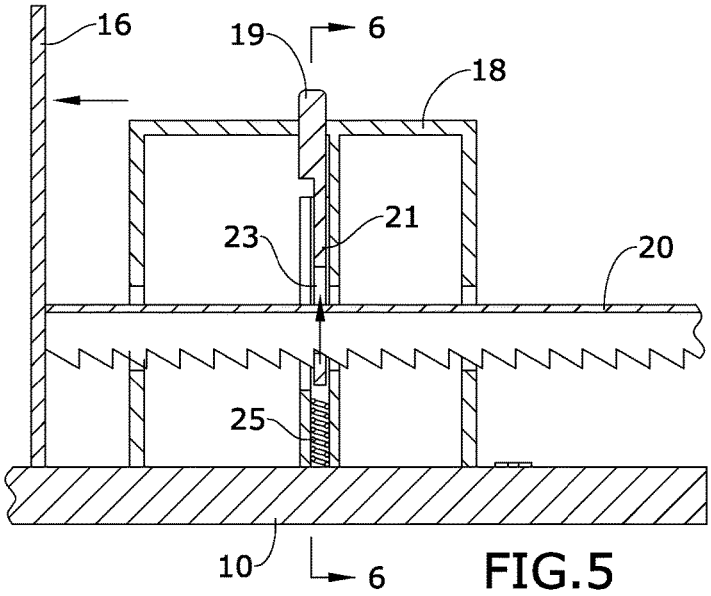
FIG. 5 is a detail section view of one embodiment of the present disclosure.
Figure 7:
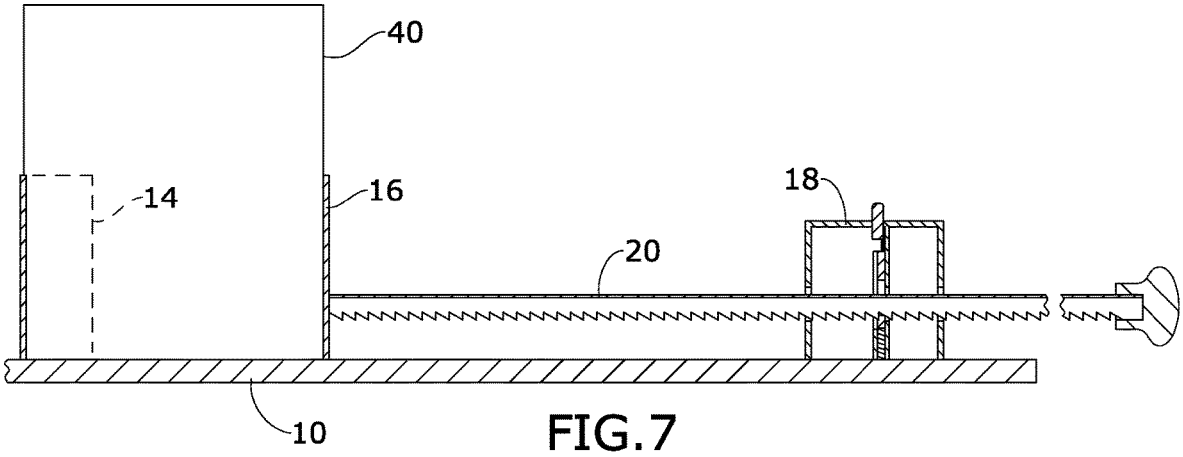
FIG. 7 is a section view of one embodiment of the present disclosure, taken along line 7-7 in FIG. 1.
Figure 8:
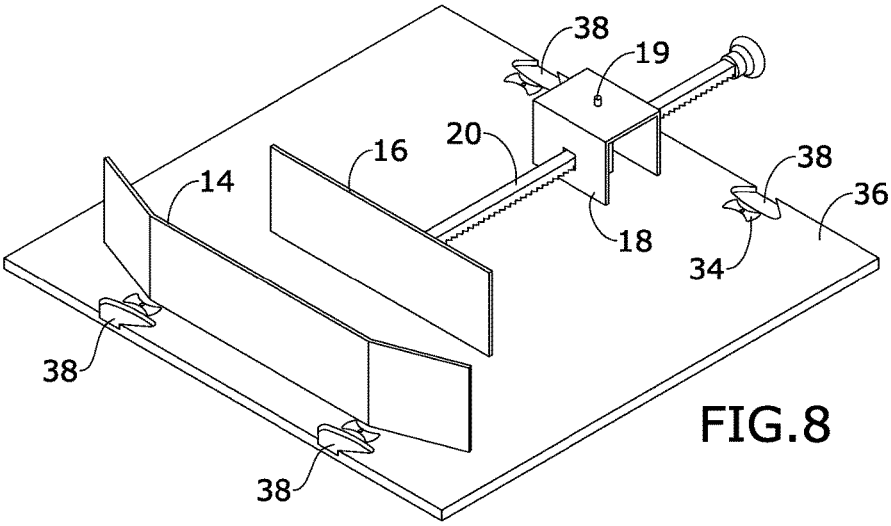
FIG. 8 is a perspective view of one embodiment of the present disclosure.
Figure 9:
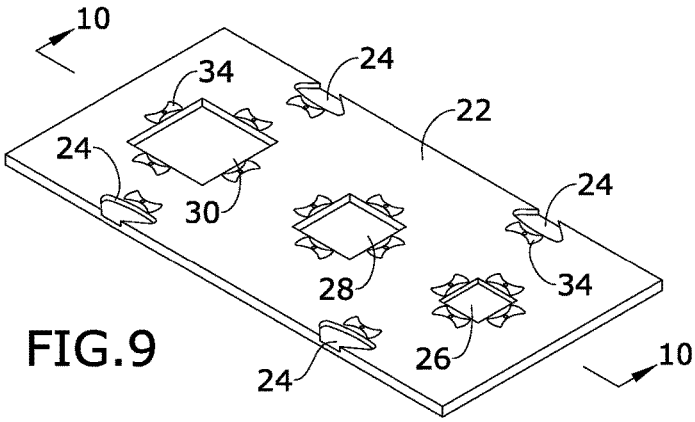
FIG. 9 is a perspective view of one embodiment of the present disclosure.

More specifically, the movable clamping wall 16 has a first surface facing the stationary clamping wall 14 and a second surface opposite the first surface. As shown in FIGS. 3-6, a ratchet bar 20 may be fixedly attached to and may extend from the second surface of the movable clamping wall 16, wherein the ratchet bar 20 may comprise at least one surface with a plurality of teeth. The ratchet bar 20 may extend through a guide 18, wherein the guide 18 may comprise a pair of support walls extending perpendicularly upwards from the launch board 10 and a top wall extending between upper edges of the pair of support walls. A first central wall may extend downward from the top wall to the launch board 10 and a second central wall may extend upward from the launch board 10 partially up toward the top wall, wherein the second central wall is spaced from the first central wall to create a plate channel. As shown in FIGS. 3-7, a spring 25 may be positioned in a bottom portion of the plate channel. A locking plate 21 may also be positioned in the plate channel above the spring 25 but below the top wall, wherein the locking plate 21 has a release button 19 extending upward from a top edge thereof, the release button 19 also extending through a button orifice in the top wall. The locking plate 23 may have a plate opening 23 extending therethrough, the plate opening 23 designed to align with openings in the first central wall, the second central wall, and each of the pair of support walls when the push button 19 is pressed downward, causing compression of the spring 25, as shown in FIG. 4. When the plate opening 23 is so aligned with the openings in the walls, the ratchet bar 20 may be allowed to slide therethrough, allowing for adjustment and movement of the movable clamping wall 16. When the push button 19 is released, the spring 25 may cause the locking plate 21 to move upward within the plate channel toward the top wall, resulting in teeth on the ratchet bar 20 to engage with the lower edge of the plate opening 23, locking the ratchet bar 20 in place and preventing movement of the ratchet bar 20 and, thus, the movable clamping wall 16.

In embodiments, outer edges of the launch board 10 may comprise at least one, such as a plurality of, key slots 12 therein. The key slots 12 may be sized to accommodate insertion of one half of a connecting plug 32 therein to allow connection of adjacent launch boards 10, creating an overall larger launch pad. In embodiments, the connection plugs 32 may be substantially hourglass shaped, wherein each of the key slots 12 are shaped like half of an hourglass. However, the use of other shaped key slots 12 and connecting plugs 32 are envisioned. The launch board 10 may further comprise spinning retainers 34 positioned proximate to each key slot 12, such that the connecting plug 32 may be secured into the key slot 12 by pivoting the spinning retainer 34.

While the above description includes a singular launch board 10 comprising a mortar board portion 22 and a cake stand portion 36, in some embodiments the mortar board portion 22 and the cake stand portion 36 are stand-alone launch pads that may be removably engaged with each other or with the singular launch board to create a customizable launch platform. In such embodiments, the cake stand portion 36 may comprise a plurality of cake stand key slots 38, and the mortar board portion 22 may comprise a plurality of mortar board key slots 24. Otherwise, the structure of the standalone cake stand portion 36 and the standalone mortar board portion 22 may the same as those integrated into the singular launch board 10.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A launch platform for securing pyrotechnic explosives prior to, during, and after detonation, the launch platform comprising a launch board comprising:

a cake stand portion comprising:

a base;

a stationary clamping wall fixedly attached to and extending substantially perpendicularly upwards from the base;

a moveable clamping wall slidably engaged with the base, the movable clamping wall configured to move away from and toward the stationary clamping wall to securely accommodate a firework there between; and a ratcheting system operatively attached to the movable clamping wall, the ratcheting system configured to provide for movement and securement of the moveable clamping wall, the ratcheting system comprising:

a ratchet bar with a toothed edge extending from a surface of the moveable clamping wall opposite the stationary wall;

a guide fixedly attached to the base, the guide comprising a pair of support walls extending perpendicularly upwards from the base and a top wall extending between upper edges of the pair of support wall; and a locking plate slidably positioned within the guide, the locking plate having a release button extending upward therefrom, wherein:

the release button extends upward through the top wall;

the locking plate is configured to move up and down within the guide; and the locking plate includes a plate opening sized to accommodate passage of the ratchet bar therethrough.

2. The launch platform of claim 1, further comprising a spring positioned within the guide and between the locking plate and the base.

3. The launch platform of claim 1, wherein the launch board further comprises a mortar board portion operatively attached to the cake stand portion, the mortar board portion comprising at least one mortar board slot extending therein, the mortar board slot sized to accommodate a base portion of a mortar shell.

4. The launch platform of claim 3, further comprising at least one spinning retainer positioned proximate to an edge of the at least one base slot.

5. The launch platform of claim 3, wherein the mortar board portion is attached to the cake stand portion such that the launch board is a singular board.

6. The launch platform of claim 3, wherein:

the cake stand portion comprises at least one cake stand key slot positioned at an edge thereof;

the mortar board portion comprises at least one mortar board key slot positioned at an edge thereof; and a connecting member is configured to operatively engage with each of the at least one cake stand key slot and the at least one mortar board key slot to secure the cake stand portion to the mortar board portion.

7. The launch platform of claim 6, further comprising at least one key slot spinning retainer positioned adjacent to each of the at least one cake stand key slot and the at least one mortar board key slot, the at least one key slot spinning retainer configured to pivot with respect to the at least one cake stand key slot and the at least one mortar board key slot.

8. A launch platform for securing pyrotechnic explosives prior to, during, and after detonation, the launch platform comprising a launch board comprising:

a cake stand portion comprising:

a base;

a stationary clamping wall fixedly attached to and extending substantially perpendicularly upwards from the base;

a moveable clamping wall slidably engaged with the base, the movable clamping wall configured to move away from and toward the stationary clamping wall to securely accommodate a firework there between; and a ratcheting system operatively attached to the movable clamping wall, the ratcheting system configured to provide for movement and securement of the moveable clamping wall;

a mortar board portion operatively attached to the cake stand portion, the mortar board portion comprising at least one mortar board slot extending therein, the mortar board slot sized to accommodate a base portion of a mortar shell; and at least one spinning retainer positioned proximate to an edge of the at least one base slot.

9. A launch platform for securing pyrotechnic explosives prior to, during, and after detonation, the launch platform comprising a launch board comprising:

a cake stand portion comprising:

a base;

a stationary clamping wall fixedly attached to and extending substantially perpendicularly upwards from the base;

a moveable clamping wall slidably engaged with the base, the movable clamping wall configured to move away from and toward the stationary clamping wall to securely accommodate a firework there between; and a ratcheting system operatively attached to the movable clamping wall, the ratcheting system configured to provide for movement and securement of the moveable clamping wall; and a mortar board portion operatively attached to the cake stand portion, the mortar board portion comprising at least one mortar board slot extending therein, the mortar board slot sized to accommodate a base portion of a mortar shell, wherein:

the cake stand portion comprises at least one cake stand key slot positioned at an edge thereof;

the mortar board portion comprises at least one mortar board key slot positioned at an edge thereof; and a connecting member is configured to operatively engage with each of the at least one cake stand key slot and the at least one mortar board key slot to secure the cake stand portion to the mortar board portion.

* * * * *